US008379892B1

(12) United States Patent
Gu

(10) Patent No.: US 8,379,892 B1
(45) Date of Patent: Feb. 19, 2013

(54) ARRAY OF HIGH FREQUENCY LOUDSPEAKERS

(76) Inventor: Kang Gu, Beijing (CN)

( * ) Notice: Subject to any disclaimer, the term of this patent is extended or adjusted under 35 U.S.C. 154(b) by 1289 days.

(21) Appl. No.: 11/731,296

(22) Filed: Mar. 30, 2007

(51) Int. Cl.
*H04R 5/02* (2006.01)

(52) U.S. Cl. ..... 381/304; 381/305

(58) Field of Classification Search ..... 381/87, 381/98, 152, 396, 398, 400, 423, 431, 304, 381/305
See application file for complete search history.

(56) References Cited

U.S. PATENT DOCUMENTS

| | | | | |
|---|---|---|---|---|
| 4,969,196 | A | 11/1990 | Nakamura | |
| 5,590,214 | A | 12/1996 | Nakamura | |
| 6,009,182 | A | 12/1999 | Gunness | |
| 6,112,847 | A | 9/2000 | Lehman | |
| 6,804,367 | B2 * | 10/2004 | Asada et al. | 381/398 |
| 2001/0031060 | A1 * | 10/2001 | Carver | 381/345 |
| 2003/0063758 | A1 * | 4/2003 | Poletti | 381/91 |
| 2004/0240698 | A1 * | 12/2004 | Eaton | 381/351 |
| 2006/0018491 | A1 * | 1/2006 | Stiles | 381/97 |

* cited by examiner

*Primary Examiner* — Fan Tsang
*Assistant Examiner* — Eugene Zhao

(57) ABSTRACT

The present invention is an array of high-frequency loudspeakers with three or more closely coupled bodies. Linear widths of said bodies of loudspeakers along a linear array axis are 5 centimeters or less and adjacent loudspeakers are separated by 5 centimeters or less.

2 Claims, 3 Drawing Sheets

ARRAY OF HIGH FREQUENCY LOUDSPEAKERS

The present invention relates to linear arrays of high-frequency loudspeakers, especially those operating in an outdoor venue.

BACKGROUND OF THE INVENTION

An array of high-frequency loudspeakers operating in a specific orientation among a structure of sound reflecting surfaces is very complex. Enclosed rooms for listening to music or a performance present a more or less predictable reflective environment, depending on size, shape, volume, and materials of reflective surfaces. Sound reaching a listener consists of both direct sound and reflected sound delayed by the time it takes for reflected sound to reach a listener. In addition, arrays of loudspeakers are subject to similar conflicts, in that cancellation and addition can occur at certain frequencies, changing the timbre and character of the sound. Comb filtering from closely arranged loudspeakers is a significant problem. These detectable audio effects can seriously affect a listener's appreciation of the sound being reproduced by the loudspeakers. A listener's ears are very sensitive to these small variations. So a loudspeaker system can sound very different at different listening positions or in different rooms.

Operating a loudspeaker system outdoors significantly reduces the problem of reflected sound cancellation and addition. However, specific problems arise in outdoor venues as well.

A significant factor in the operation of a loudspeaker system is the amount of diffusion present in the environment. Clearly, operating a loudspeaker system outdoors can suffer from diffusion and sound deficient at higher frequencies.

Loudspeaker arrays are essential to operation of an effective performance in an outdoor venue. As such, a primary concern is not only providing sufficient numbers of loudspeakers in a central location but also assembling each array so that comb filtering does not significantly affect a listener's appreciation of the sound.

Linear and tightly-arranged arrays are widely used in large-scale venues and arenas. However, the audio output of prior art arrays of high-frequency loudspeakers have been found to be subject to effects comb filtering which is easily heard by listeners. It is well known in the art that for a linear array of loudspeakers to operation at, for instance, a 16 KHz frequency channel without comb filtering, the calculated center to center distances between each loudspeaker may not be greater than 1.1 centimeter so that the sound pressure level can be reduced. It is clearly impossible to construct such an array for loudspeakers effective in large or outdoor venues. Currently, linear arrays of high-frequency loudspeakers are formed with a different shaped horns to provide wave front rectification. The linear arrangement angle of each loudspeaker with respect to its adjacent loudspeaker is modified from a parallel orientation of the loudspeaker axes to greater than 0.75 degrees. The change in orientation is done to produce phase isolation to produce high frequencies without noticeable comb filtering. The problems produced by such changes are that for an angular orientation greater than 5 degrees, a gap between adjacent speakers is created.

SUMMARY OF THE INVENTION

The present invention is a method for using array of high-frequency loudspeakers with three or more closely coupled bodies in a large venue or outdoors. Linear widths of sound outlets of the loudspeakers along a linear array axis are 5 centimeters or less and adjacent loudspeakers are separated by less than 5 centimeters center to center of said sound outlets.

Theoretical evaluation of such arrays indicate that substantial and audible comb filtering will arise for audio output from the array at frequencies greater than 3.4 KHz. Surprisingly, the present inventor has found after extensive testing and measurement that actual placement of the invention array in outdoor venues sometimes typical of usage for this type of array that detectable comb filtering did not occur until audio output frequency exceeded 4.1 KHz. Frequencies in excess of 4.1 KHz are effectively of little audible importance in outdoor venues where input from bass and mid-range loudspeakers are contributing to the range of detectable sounds from a performance.

An object of the invention is to provide a simple structured, low cost, high-frequency loudspeaker linear array which can be used in large-scale or outdoor venues.

In a preferred embodiment, each loudspeaker comprises a sound outlet diameter of 5 centimeters or less and the center to center distance between the sound outlets of 5 centimeters or less. In a more preferred embodiment, the sound outlet diameter is 4 to 4.5 centimeters and the center to center distance between the sound outlets are 4 to 4.5 centimeters.

Arrays of the invention loudspeakers may be formed in a single, continuous body of horns, as a set of closely coupled horns, and arranged in a single row or multi-row. The invention loudspeakers comprise high-frequency compression drivers. A sound outlet axis of each loudspeaker can be arranged with respect to its adjacent loudspeaker from minus 15 degrees to plus 15 degrees. A horn is preferably at the sound outlet of some or all of the loudspeakers and adjacent sides of said horns can formed as a single wall. The length of the horns can be 2, 6 or 8 centimeters or more.

Said loudspeakers are inner magneto, external magneto type or piezoelectric ceramic loudspeakers. Their maximum sound pressure level without distortion of single loudspeaker is greater than 110 dB and the frequency range is 1.6 KHz to 16 KHz.

A horn set in the sound outlet of loudspeaker delays interference of sound waves from adjacent loudspeakers until the sound waves reach the outlet of the horn. As such, there is an effective increase in the upper frequency at which comb filtering can be detected by a listener in an outdoor venue. In some cases, the upper limit is as high as 16 KHz.

DETAILED DESCRIPTION OF THE INVENTION

The invention is now discussed with reference to the figures.

Figure 1:
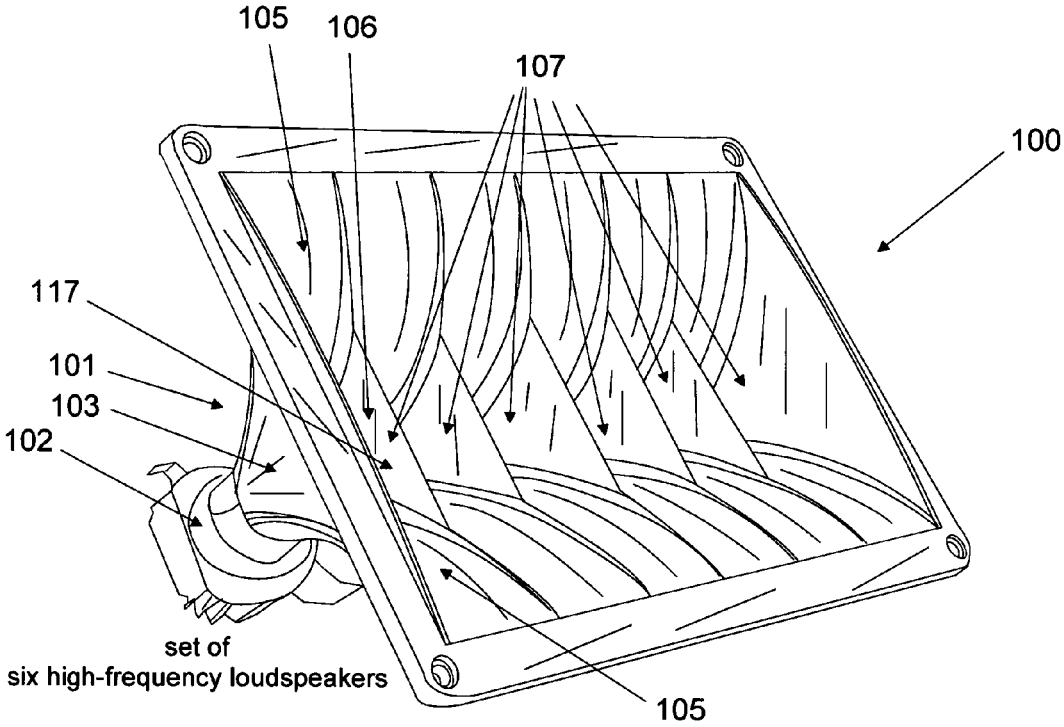
FIG. 1 is a top perspective drawing of a linear array of loudspeakers having integrally combined horns for a set of six high-frequency loudspeakers.

FIG. 1 shows linear speaker array 100 comprised of integrally formed horns 107, where each of such horns is connected to a sound outlet of a loudspeaker driver 102. Drivers 102 comprise well known high-frequency loudspeaker construction of a diaphragm supported from a peripheral frame extending to a central portion to further support a spider, wherein the central portion are located a permanent magnet and voice coil (which is connected by leads to connector tabs). The peripheral frame for the diaphragm defines a sound outlet and an axis thereof.

Figure 2:
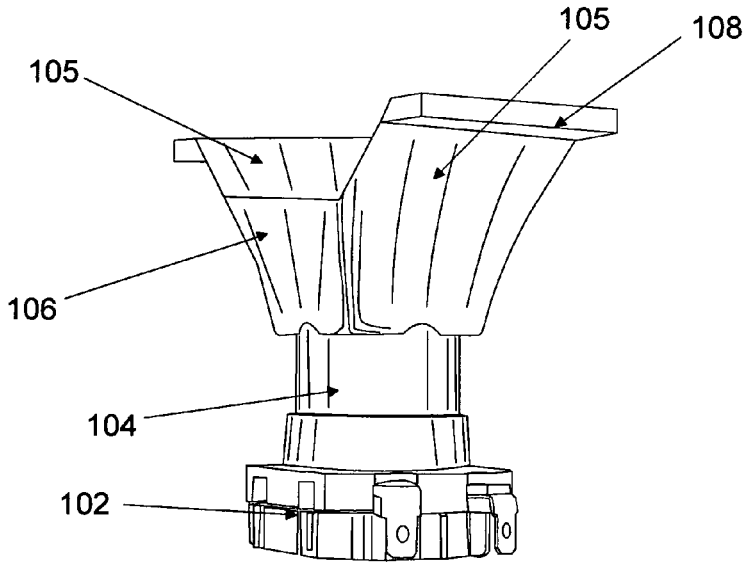
FIG. 2 is a side perspective view of one of the loudspeakers of FIG. 1.

Each of the horns 107 comprises a divider wall 106 shared with an adjacent loudspeaker 102. The entire sound box of six horns 107 is shown formed as a single, continuous piece with end walls 103 and arcuate walls 105. Opening 117 of a horn 107 is defined by end wall 103, two arcuate walls 105, and divider wall 106. FIG. 2 shows a single assembly loudspeaker 101 separated from the unified sound box of FIG. 1.

Figure 3:
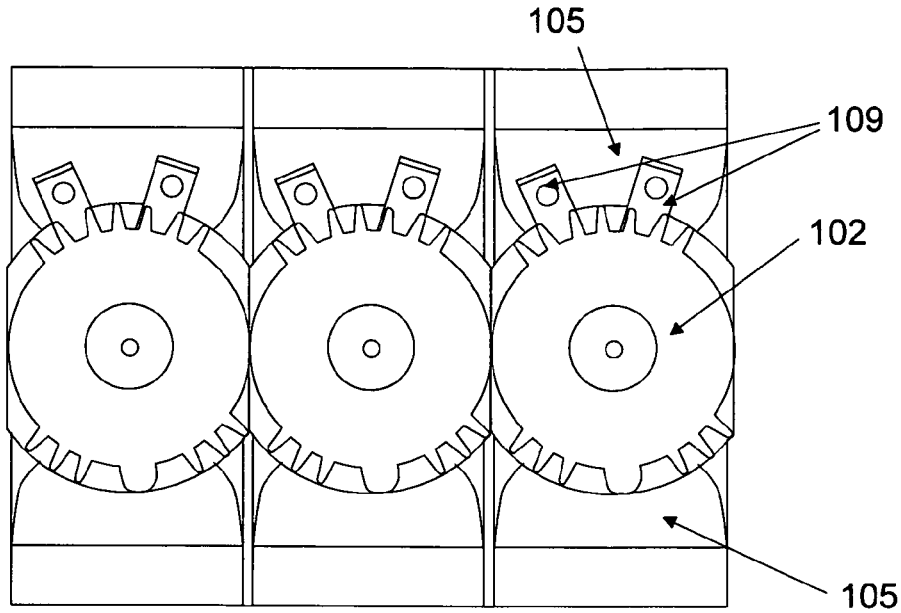
FIGS. 3 and 4 are respectively bottom and top views of three of the loudspeakers of FIG. 1.

FIG. 3 shows three of the assembly loudspeakers of FIG. 1 with connector tabs 109 for electrical connection to well known electrical signal generators and amplifiers.

Figure 4:
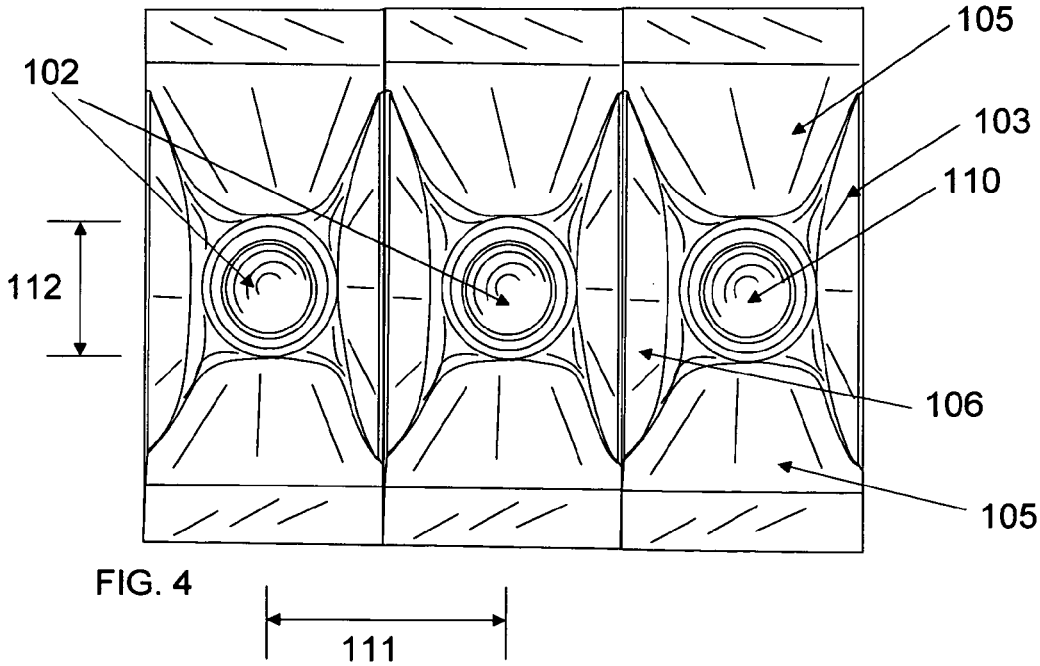

FIG. 4 shows a center to center distance 111 between drivers 102. Distance 111 is 5 centimeters or less. Distance 111 is preferably 4.0 to 4.5 centimeters. Sound outlet width 112 is 5 centimeters or less and is preferably 4.0 to 4.5 centimeters.

Figure 5:
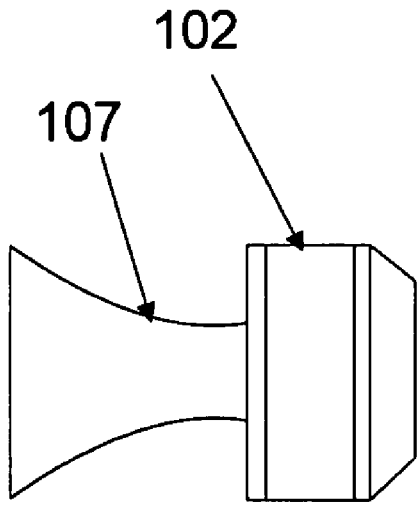
FIG. 5 is a side view of an exemplary high frequency loudspeaker.
Figure 6:
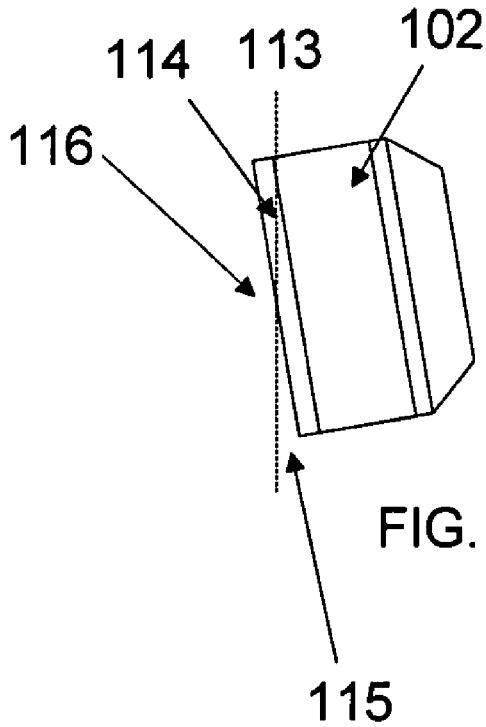
FIG. 6 is a side view of the loudspeaker of FIG. 5 without a horn showing adjacent inclination of a loudspeaker with reference to a reference plane.

FIG. 5 shows an exemplary loudspeaker driver 102 with horn 107 in side view. FIG. 6 shows the sound outlet 116 of driver 102 from FIG. 5 inclined from reference plane 113 by a positive angle 114 on one adjacent side to an adjacent driver (not shown) and by a negative angle 115 on the other adjacent side to an adjacent driver (not shown). Angles 114 and 115 may be, respectively, up to a positive 15 degrees and up to a negative 15 degrees with respect to reference plane 113. Reference plane 113 is the plane formed by the sound outlet of an adjacent driver.

The invention further comprises: a method of operating a linear array of high-frequency loudspeakers comprising: (a) three or more high-frequency loudspeakers arranged adjacent to one another such that each loudspeaker comprises a driver defining a circular sound outlet and a sound direction axis; (b) each sound outlet has a diameter of 5 centimeters or less; (c) a center to center distance defined between the sound direction axes adjacent loudspeakers is 5 centimeters or less; (d) each loudspeaker operates with maximum sound pressure level greater than 110 dB and a frequency output range is 1.6 KHz to 16 KHz; and (e) operating said linear array outdoors. The invention further comprises: (i) the preceding method wherein said drivers are inner magneto, external magneto type or piezoelectric ceramic loudspeakers and/or (ii) wherein each sound outlet defines a reference plane and at least one reference plane of one loudspeaker is inclined from 1 to 15 degrees with reference to the reference plane of an adjacent loudspeaker, optionally wherein each sound outlet defines a reference plane and at least one reference plane of one loudspeaker is inclined from 6 to 15 degrees with reference to the reference plane of an adjacent loudspeaker.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A method of operating a linear array of high-frequency loudspeakers comprising:

(a) three to six high-frequency loudspeakers arranged adjacent to one another such that each loudspeaker comprises a driver defining a circular sound outlet and a sound direction axis;

(b) each sound outlet has a diameter of 5 centimeters or less;

(c) a center to center distance defined between the sound direction axes adjacent loudspeakers is 5 centimeters or less;

(d) each loudspeaker operates with maximum sound pressure level greater than 110 dB and a frequency output range is 1.6 KHz to 16 KHz;

(e) operating said linear array outdoors; and (f) each sound outlet defining a reference plane and at least one reference plane of one loudspeaker is inclined from 6 to 15 degrees with reference to the reference plane of an adjacent loudspeaker.

2. The method of claim 1 wherein said drivers are inner magneto, external magneto type or piezoelectric ceramic loudspeakers.

* * * * *